US005473851A

United States Patent [19]

Northrup, Jr.

[11] Patent Number: 5,473,851

[45] Date of Patent: Dec. 12, 1995

[54] LIMESTONE CURTAIN WALL SYSTEM AND METHOD

[75] Inventor: Lynn L. Northrup, Jr., Dallas, Tex.

[73] Assignee: American Limestone Co., Dallas, Tex.

[21] Appl. No.: 234,464

[22] Filed: Apr. 28, 1994

[51] Int. Cl.[6] ..... E04C 1/40; E04B 1/38

[52] U.S. Cl. ..... 52/513; 52/211; 52/235; 52/506.05; 52/506.08; 52/506.09; 52/169.14

[58] Field of Search ..... 52/235, 506.05, 52/506.08, 506.09, 513, 211, 169.14

[56] References Cited

U.S. PATENT DOCUMENTS

| | | | |
|---|---|---|---|
| 360,625 | 4/1887 | Snell . | |
| 373,946 | 11/1887 | Richardson | 52/169.14 |
| 1,909,625 | 5/1933 | Meier . | |
| 1,968,393 | 7/1934 | Henderson | 72/41 |
| 1,985,160 | 12/1934 | Gates | 72/14 |
| 2,011,510 | 8/1935 | Ackenbrack | 72/19 |
| 2,061,263 | 11/1936 | Wells | 52/211 |
| 2,160,792 | 5/1939 | Cantwell | 72/41 |
| 2,227,228 | 12/1940 | Payne | 72/14 |
| 2,245,785 | 6/1941 | Jentzer, Jr. | 52/506.08 |
| 2,304,333 | 12/1942 | Bossi | 72/101 |
| 2,432,445 | 12/1947 | Roe | 72/18 |
| 2,518,640 | 8/1950 | Purinton | 72/44 |
| 3,295,287 | 1/1967 | Pasquale | 52/714 |
| 4,467,587 | 8/1984 | Montagnon | 52/169.14 |
| 4,598,518 | 7/1986 | Hohmann | 52/410 |
| 4,622,796 | 11/1986 | Aziz et al. | 52/747 |
| 4,809,470 | 3/1989 | Bauer et al. | 52/97 |
| 4,811,537 | 3/1989 | D'Epenoux | 52/235 |
| 4,852,320 | 8/1989 | Ballantyne | 52/303 |
| 4,955,172 | 9/1990 | Pierson | 52/710 |
| 5,134,814 | 8/1992 | Houser | 52/211 |
| 5,379,561 | 1/1995 | Saito | 52/235 |

FOREIGN PATENT DOCUMENTS

| | | | |
|---|---|---|---|
| 628188 | 8/1949 | United Kingdom | 52/211 |

*Primary Examiner*—Carl D. Friedman
*Assistant Examiner*—W. Glenn Edwards
*Attorney, Agent, or Firm*—Jenkens & Gilchrist

[57] ABSTRACT

A limestone veneer system for exterior and interior walls of buildings including anchors secured along the foundation, dry wall sheathing, and cornices of the buildings. The anchors engage edge slots in limestone panel and molding members forming the veneer system. Base panels and molding form a water table section of the veneer. Wall panels in horizontal vertically spaced rows comprise the limestone veneer over the wallboards of the building. An entablature formed by cornice molding members, frieze molding, and architraves of limestone are attached by the anchors to the wallboard and cornice sheathing. The limestone members are supported in spaced relation from the building wallboards and may include joints sealed by plastic caulking members.

2 Claims, 12 Drawing Sheets

LIMESTONE CURTAIN WALL SYSTEM AND METHOD

This invention relates to curtain wall construction and methods for residential and commercial buildings and more particularly relates to a limestone veneer curtain wall system and method.

BACKGROUND OF THE INVENTION

For hundreds of years natural limestone has been a favored finish material on both the exteriors and interiors of buildings. The exquisite texture, color, and line of natural limestone coveys a richness and dignity not found in other materials used to finish walls and adjacent surfaces of buildings. The cost of both the materials and the known methods of installing heavy limestone panels has limited the use of the material. While in recent years the return of residential and commercial architecture to more historic designs has increased the popularity of limestone, the high cost has often required the substitution of brick, stucco, or simulated stone. The use of relatively thick limestone panels, such as two inches (2 in.) or more, has required traditional installation materials and techniques, including laying the stone one on the other using mortar joints in much the same manner as brick walls and related structures are constructed.

SUMMARY OF THE INVENTION

It is a principal object of the invention to provide a new and improved system and a method for the installation of curtain walls and related structure on the interior and exterior walls of buildings.

It is another object of the invention to provide new and improved apparatus and methods for the installation of natural limestone veneer on interior and exterior walls of buildings.

In accordance with a preferred exemplary embodiment of the present invention, there is provided a system of and method for installing limestone veneer facings on interior and exterior walls of buildings including limestone wall panels arranged in vertically spaced horizontal rows, held in coplanar relationship spaced apart from the face of the wallboard by anchors attached to the wallboard engaging edge opening in the limestone panels. Each of the anchors has a first back portion for attachment to the wallboard, an intermediate portion extending outward from the first portion, and a front portion positioned at an angle with the intermediate portion for engagement in edge openings of the limestone panels. One double form of the anchor for engagement with limestone panels in adjacent rows includes two coplanar forward portions extending in opposite directions relative to the intermediate portion for engagement in edge openings of adjacent limestone panels. Another single form of the anchor includes a single front portion for engagement in lower edge openings of bottom rows of limestone panels along a wall. The limestone panels are spaced one from the other vertically and horizontally with the joint between panel edges being left open, or, if desired, sealed. Entablature moldings are also provided including a cornice, a frieze, and an architrave having edge openings for securing by the edge anchors to a wall above the coplanar wall panels. Limestone window and door surround moldings having edge openings are provided for attachment to the walls by the anchors. Other limestone components includable in the system are water table moldings attached by the anchors on a building foundation below the coplanar wall panels.

DETAILED DESCRIPTION OF A PREFERRED EXEMPLARY EMBODIMENT OF THE INVENTION

Figure 1:
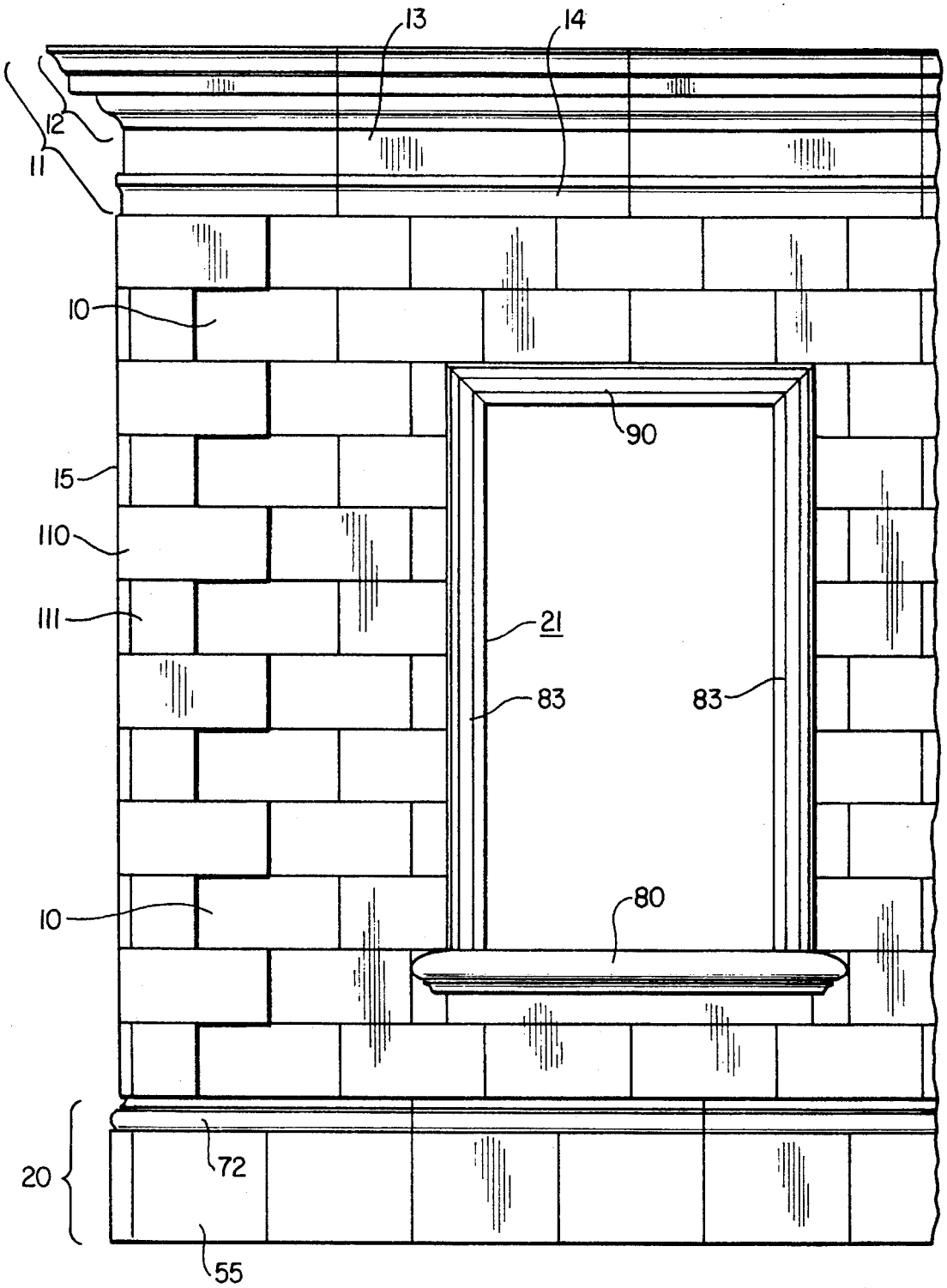
FIG. 1 is a fragmentary view in elevation of a limestone veneer wall in accordance with an exemplary embodiment of the invention including limestone wall panels, entablature molding, window surround molding, and water table section molding.

Referring to FIG. 1, a typical limestone veneer curtain wall of a building in accordance with the invention includes horizontal, vertically spaced, rows of limestone wall panels 10, an entablature 11 comprising a cornice 12, a frieze 13, an architrave 14, a quoined corner 15, a water table section 20, and window surround molding 21. The components which make up the limestone building veneer shown in FIG. 1 are all installed on standard drywall or similar building wall construction using apparatus and methods in accordance with the invention as illustrated in more detail in FIGS. 2–4 and 13–16.

Figure 2:
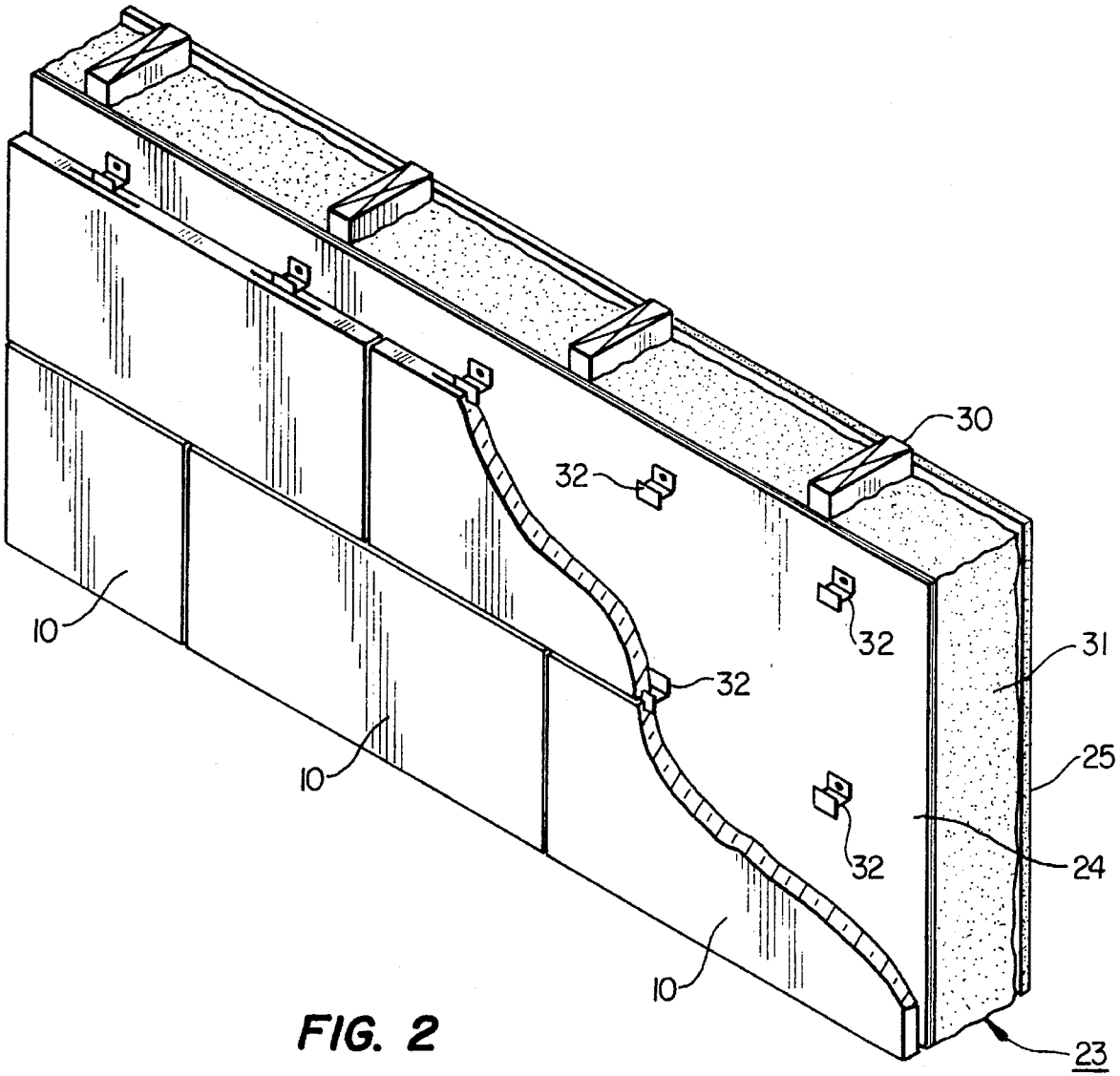
FIG. 2 is a fragmentary perspective view in section and elevation showing the installation of limestone wall panels on the wallboard of a drywall in accordance with the invention.
Figure 5:
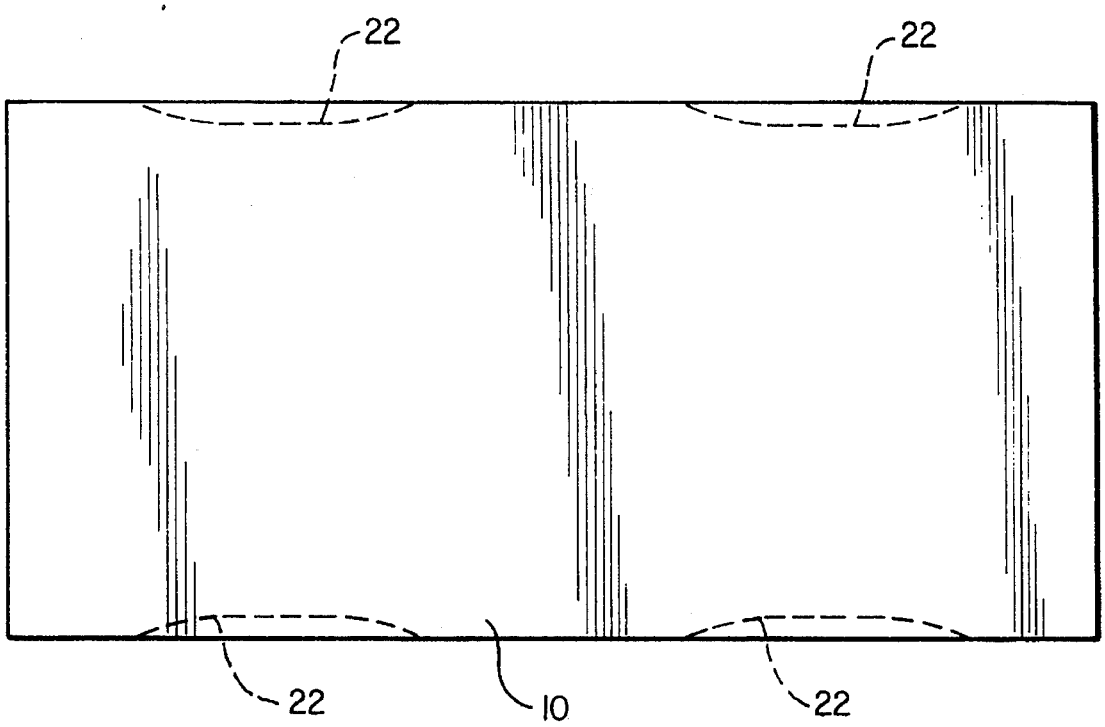
FIG. 5 is a view in elevation of a typical limestone wall panel employed in the invention showing in phantom lines edge openings or slots for anchors for attaching the panel to wallboard.
Figure 6:
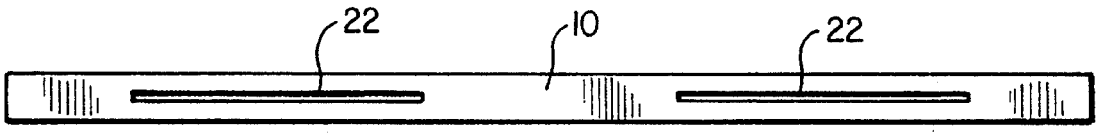
FIG. 6 is an edge view of the limestone panel of FIG. 5 illustrating the edge openings for the anchors.

The limestone wall panels 10 are installed on a drywall of a building structure as illustrated in FIG. 2. Details of each of the limestone panels 10 are shown in FIG. 5. Referring to FIG. 5, each of the limestone panels 10 is rectangular in shape and cut, typically, approximately one inch (1") in thickness, which is substantially thinner than limestone panels installed by prior art techniques. Each of the panels 10 has edge openings or slots 22 formed in the top and bottom edges of each panel. The edge slots 22 are of sufficient length and depth to provide enough tolerance for proper alignment of the panels as they are installed. The thickness of the edge slots 22, however, is cut to close tolerances for uniform spacing of the panels from the face of the wallboard on which the panels are installed. Referring to FIG. 2, a typical drywall 23 on which the panels are installed on either the interior or exterior includes wallboard 24 and wallboard 25 attached to studs 30 with the voids between the studs and wallboards being filled with insulation 31. Vertically spaced horizontal rows of anchors 32 are secured on the outer face of the wallboard 24 in longitudinally spaced relation along each of the horizontal rows.

Figure 7:
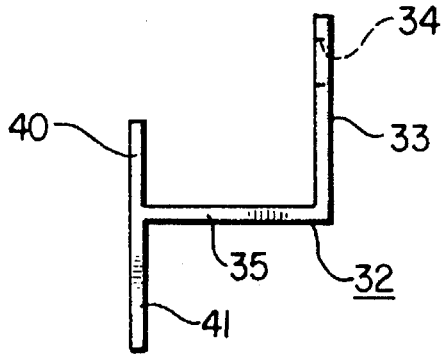
FIG. 7 is a side view in elevation of a double anchor employed in the invention for attachment of limestone panels and molding to wallboard.
Figure 8:
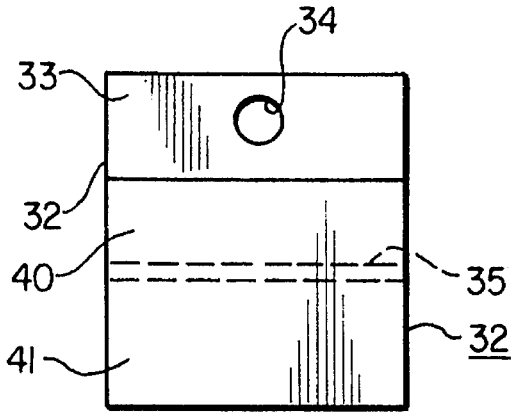
FIG. 8 is a front view in elevation of the double anchor of FIG. 7.
Figure 12:
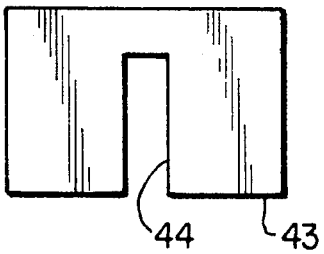
FIG. 12 is a view in elevation of a shim used in the apparatus of the invention between an anchor and the face of wallboard.
Figure 13:
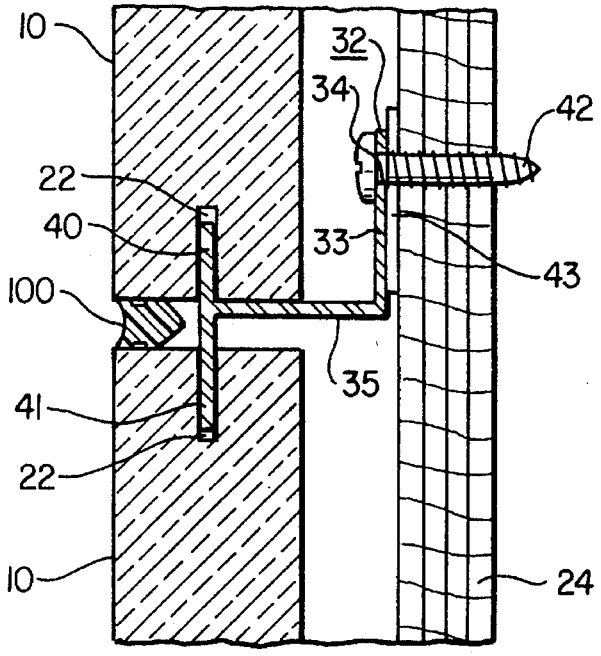
FIG. 13 is a fragmentary side view in section and elevation showing the installation of limestone wall panels on a wallboard using a double anchor in accordance with the invention, including the joint sealer of FIG. 11 between adjacent wall panels.

Each of the anchors 32 is a double anchor, FIGS. 7 and 8, attached to the wallboard 24 as shown in FIG. 13. Each anchor 32 is an integral part formed by a vertical back portion 33 having a bolt or screw hole 34, a horizontal intermediate portion 35, and front upper and lower coplanar portions 40 and 41, respectively. The back portion 33 and the front portion 40 and 41 lie in parallel, spaced, planes. The anchor 32 is preferably formed of metal with the front portion 40 and 41 and a section of the intermediate portion 35 coated with a corrosion resistant plastic. The anchor 32 is secured to the wallboard 24 by a screw 42 installed through the hole 34 in the back portion 33 of the anchor. An impact resistant plastic shim 43, designed as illustrated in FIG. 12, is positioned on the front face of the wallboard 24 between the wallboard and the back portion 33 of the anchor. The shim has a slot 44 for the screw 42.

The installation of the limestone wall panels 10, illustrated in FIGS. 2 and 3, includes the panels 10 in horizontal rows above the water table section, FIG. 15, and below the entablature, FIG. 14. The double anchors 32 are secured in vertically spaced, horizontal rows on the wallboard with the desired joint spacing, such as one quarter inch (¼"), horizontally and vertically between the edges of the panels. The positioning of the anchors 32 on the wallboard 24 in vertically spaced horizontal rows is determined by the horizontal and vertical distances between the panel edge slots 22 so that along a row of the anchors the lower front anchor portions 41 fit into the top edge slots of the panels below the anchors, and the upper front anchor portions 40 fit into the bottom edge slots 22 of the panels above each anchor row. As evident in FIG. 13, the depth of the edge slots 22 in the limestone panels 10 is greater than the height of the front anchor portions 40 and 41. Thus, the bottom edge of each of the panels 10 rests on and the panel is supported by the top surface of the intermediate anchor portions 35 of the anchors below each horizontal row of the limestone panels 10. Thus, each row of the anchors is positioned to align the vertical distance between the top surfaces of the anchor portion 35 in adjacent anchor rows spaced apart the vertical height of panels 10 plus the desired thickness of the joint between the panels. For example, for typical panels eleven and three quarter inches high (11¾"), the rows of the anchors 10 are spaced to provide twelve inches (12") between the top surfaces of the anchor members 35. Also, the spacing of the panels 10 from the front face of the wallboard 24 is dependent upon the thickness of the panels, the position of the edge slots 22 in the panels, the length of the anchor intermediate portion 35, and the thickness of the shim 43. Because the anchors 32 are attached to the wallboard 24 by the upwardly extending back portion 33, the rows of the panels 10 must be installed on the wallboard 24 sequentially, beginning first with the bottom row of the panels. As each lower row of anchors 10 is aligned and secured on the wallboard 24, the row of the limestone panels 10 are placed on the row of anchors with the next upper row of anchors being aligned and installed with the lower front portion 41 of each anchor being inserted into the edge slot 22 along the top edge of each panel 10 and the anchor then being attached by the screw 42 into the wallboard 24 above the just installed panel 10.

While the installation and method of the invention has been described with respect to the limestone panels 10 over a wall above the water table section of FIG. 15 and below the entablature of FIG. 14, it will be recognized that the sequential installation of the limestone veneer of the invention, due to the structure of the mounting anchors and the limestone panels and related components, must begin from the bottom up with the water table section first.

Figure 9:
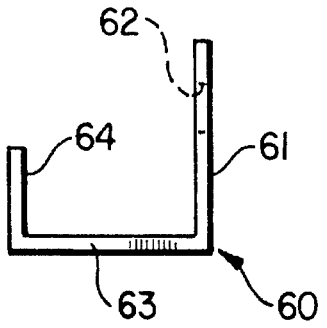
FIG. 9 is a side view in elevation of a single anchor employed in the apparatus and method of the invention for attachment of limestone panels and moldings to wallboard.
Figure 10:
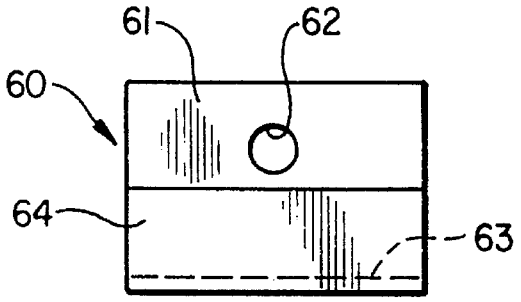
FIG. 10 is a front view in elevation of the single anchor of FIG. 9.
Figure 15:
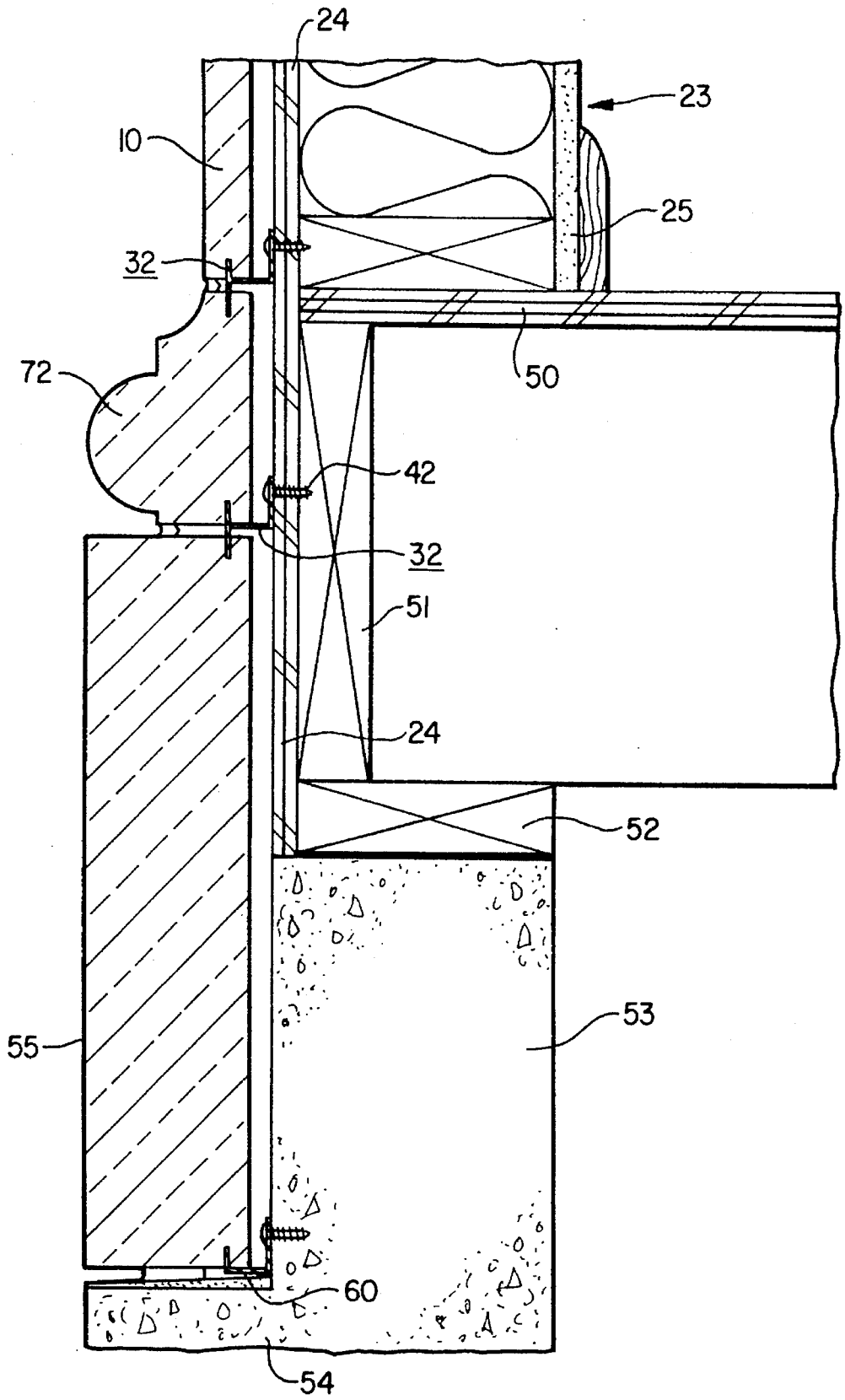
FIG. 15 is a fragmentary side view in section showing the installation of the water table section of a limestone veneer along the wall of a building in accordance with the invention.
Figure 16:
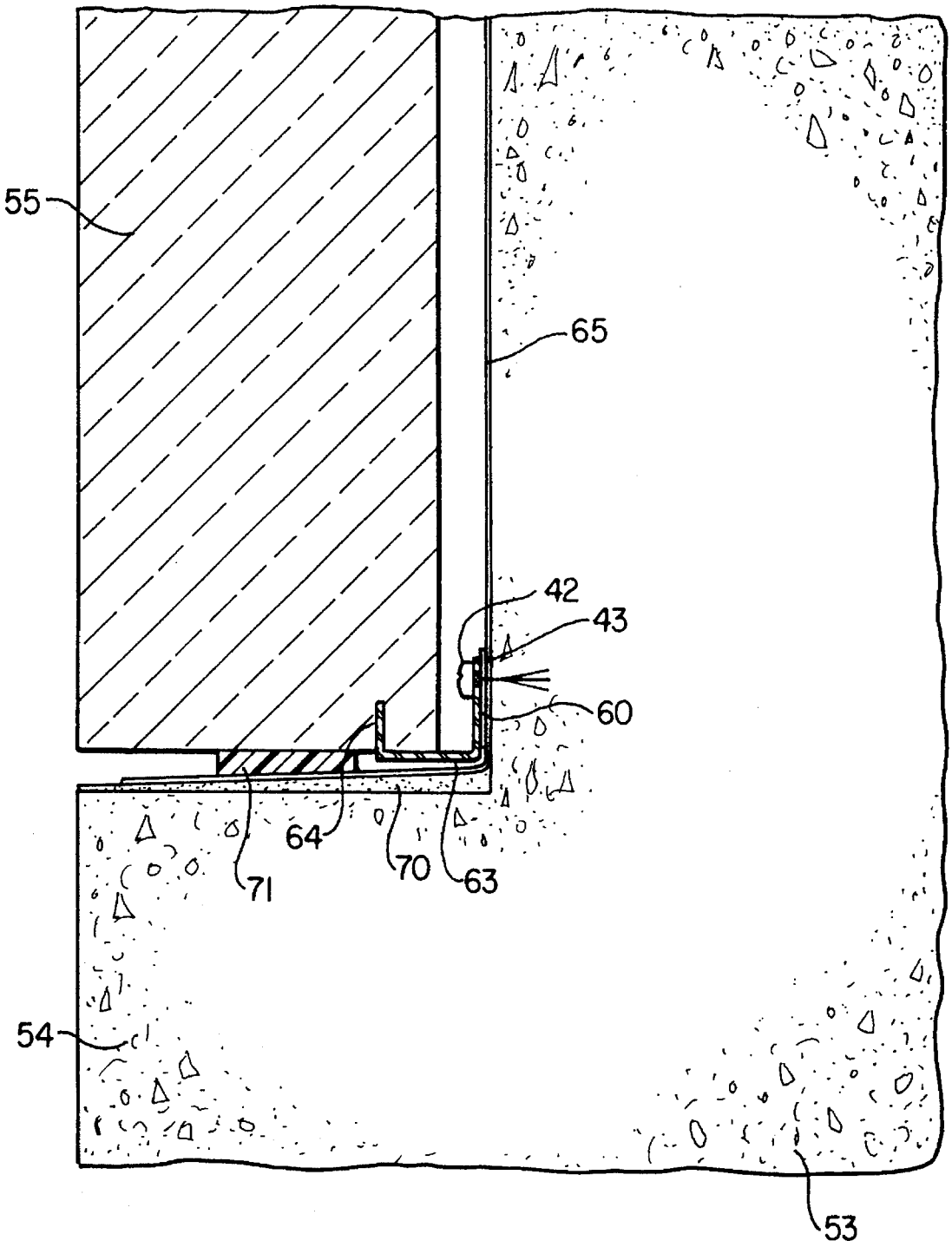
FIG. 16 is an enlarged fragmentary section of a lower portion of the water table section shown in FIG. 15 illustrating waterproofing of the water table section and the surface of the building foundation beam.

Referring to FIG. 15, the drywall 23 is supported on a floor 50 resting on floor joists 51 along a plate 52 on a concrete foundation beam 53 having a foot or extension portion 54 along the outside of the foundation. The water table section 20 of the limestone veneer of the invention, FIGS. 1, 4, and 15, includes a limestone base 55 designed structurally as the panels 10 except that the base 55 is significantly thicker than the panels 10. Each of the water table bases has top and bottom edges lots 22 cut into the bases on the same spacing and the same distance from the back face as in the panels 10. Each water table base 55 is supported on single anchors 60 illustrated in detail in FIGS. 9 and 10, or a continuous anchor having a cross section as in FIG. 9 but several inches to several feet long as needed. Each single anchor 10 is an integral part having an upper back portion 61 provided with a screw or bolt hole 62, an intermediate portion 63 perpendicular to the back portion, and an upper front portion 64. The single anchors 60 are used in those installations where the anchor is holding only a single limestone panel or other component above the anchor in contrast with the double anchor which serves two adjacent limestone components above and below the anchor. Referring to FIG. 16 showing in greater detail the lower portion of the water table section, the foundation beam along the outer surface is lined with a water proof material 65 which may be a synthetic sheet material such as sold under the trademark DUPONT TYVEK. A lower end portion of the water proofing layer 65 is laid across the beam foot 54 over a sloping material 70 sold under the trademark POR-ROCK. The limestone water table base panel 55 is mounted on single bottom anchors 60 or a continuous anchor as long or longer than the limestone panel, secured to the foundation beam 53 over the liner 65 and a shim 43 by an anchor screw 42. A coated urethane baffle 71, which is a tapered member sloping to match the slope of the top surface of the liner 71 along the material 70, is installed below the base 55.

Referring back to FIG. 15, the water table section 20 also includes a limestone molding 72 provided with top edge and lower edge slots 22 spaced and dimensioned as in the panels 10. The molding 72 is mounted on the drywall wallboard 24 by double anchors 32 secured to the wallboard by screws 42. The bottom row of double anchors 32 supporting the bottom row of the limestone wall panels 10 along the wallboard 24 also engage the top edge slots of the water table molding 72. The front bottom anchor portions 41 engage the top edge slots 22 in the molding 72. As previously stated, in the sequential installation of the limestone veneer on a building wall, the water table section is first installed followed by the bottom row of the limestone wall panels 10.

Figure 3:
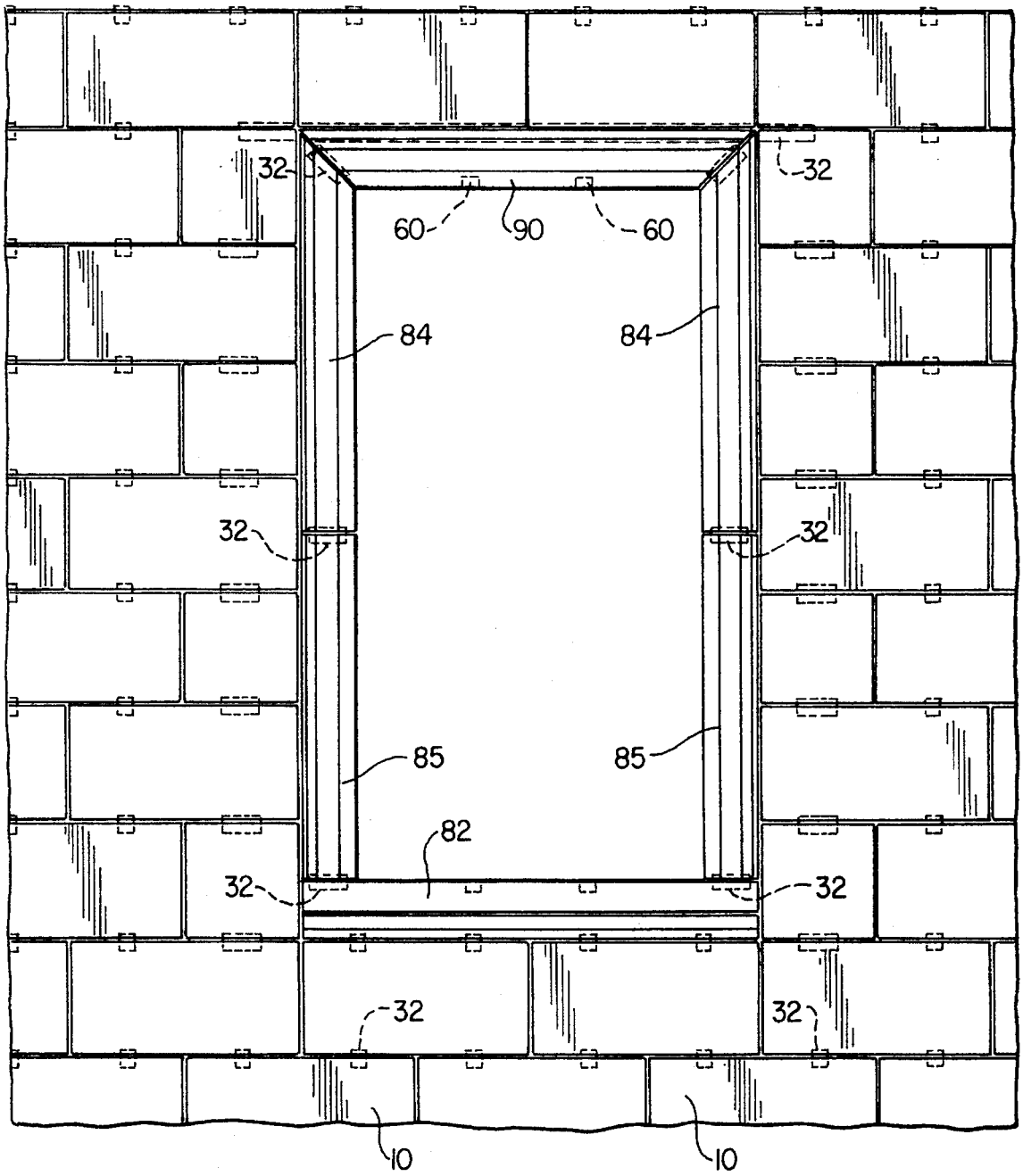
FIG. 3 is a fragmentary view in elevation of limestone panels and windows surround molding showing in phantom lines the placement of anchors attaching the wall panels and window surround molding to wallboard.
Figure 4:
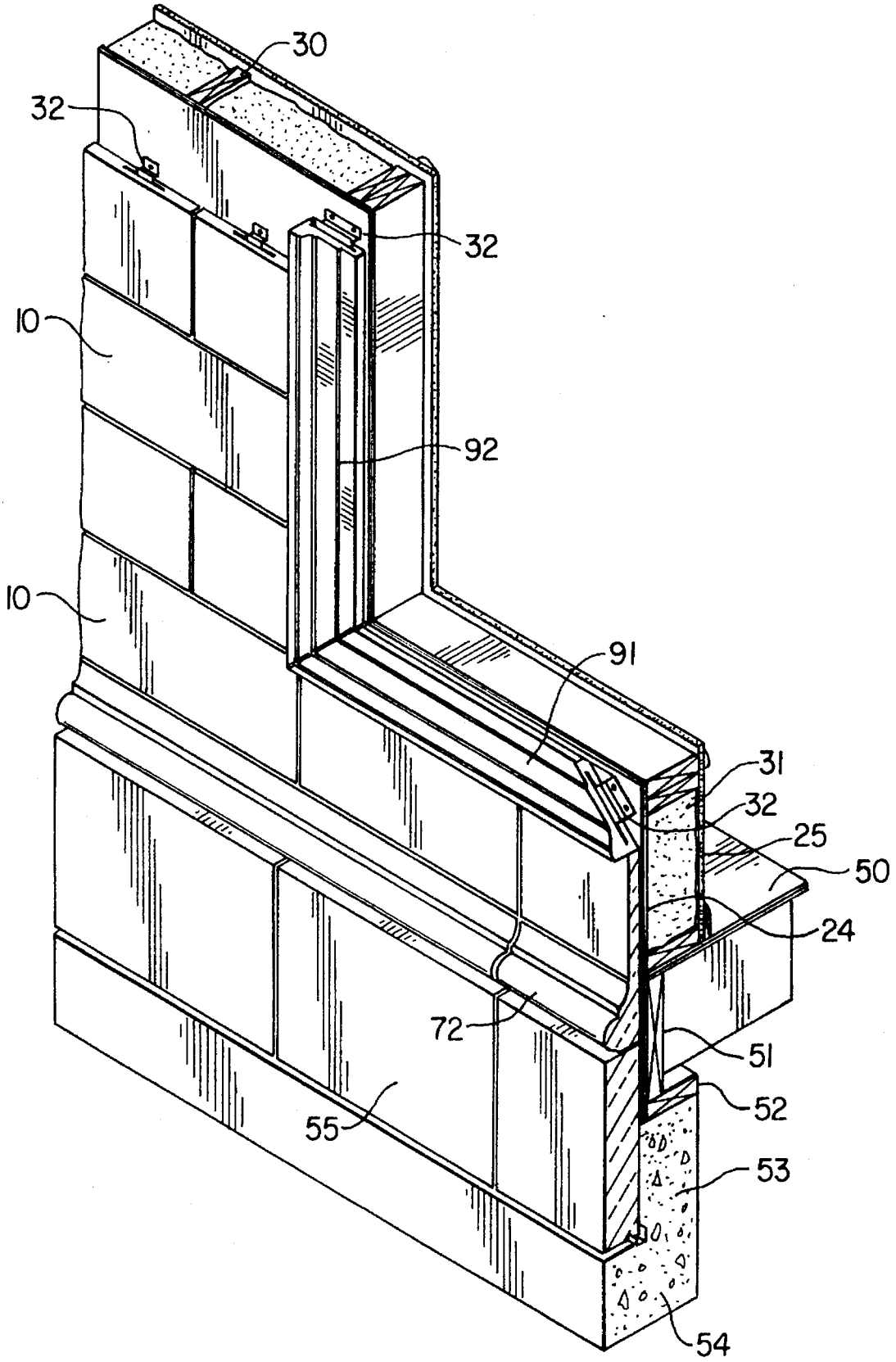
FIG. 4 is a fragmentary perspective view in section and elevation showing portions of limestone wall panels, window surround molding, and water table molding installed on wallboard.
Figure 17:
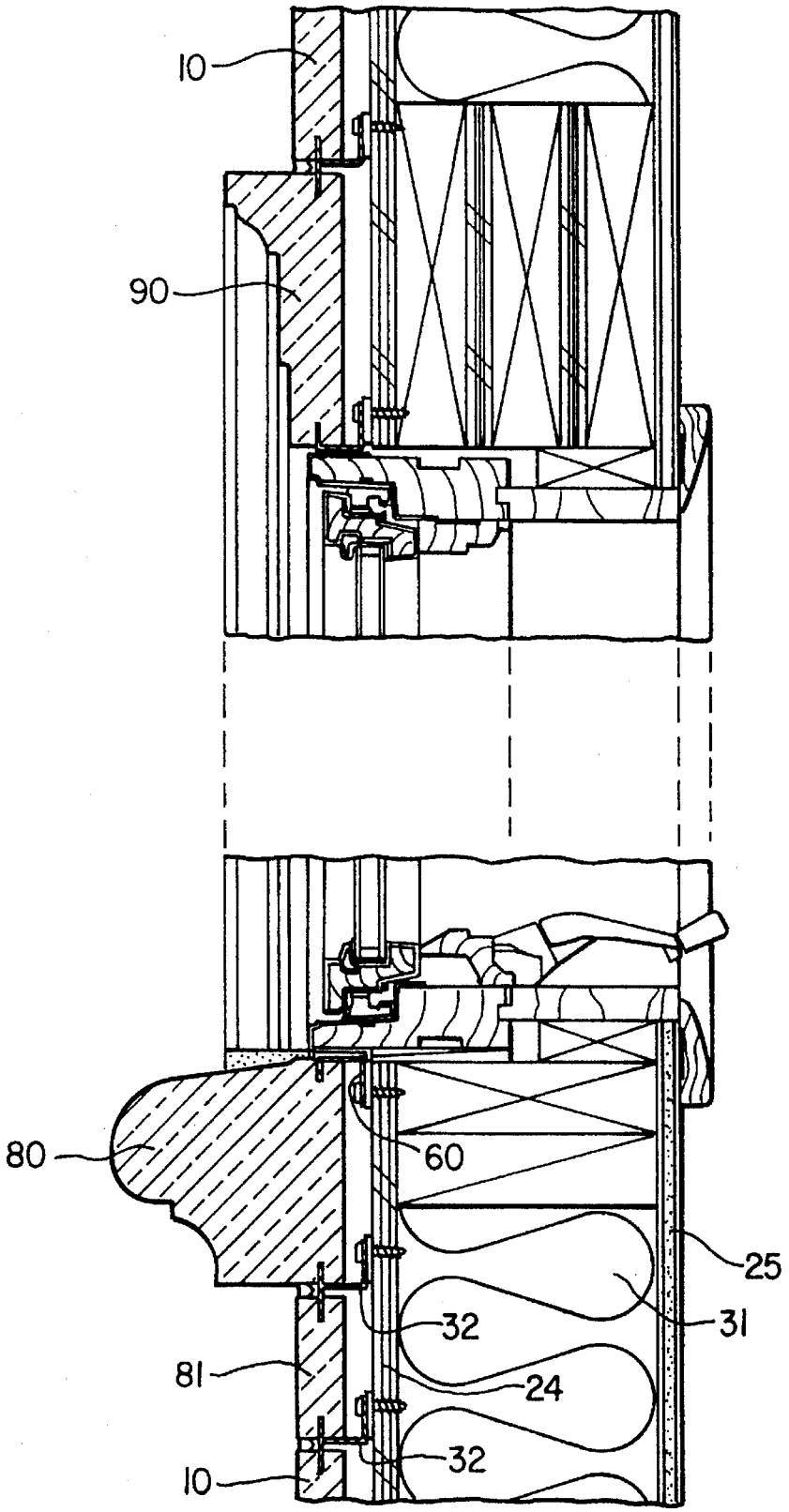
FIG. 17 is a fragmentary broken side view in section of limestone window surround molding in accordance with the invention.

Following the installation of the water table section, and during the installation of the limestone wall panels 10, if windows are in the walls over which the veneer is being installed, the window surround molding, such as identified by the reference numeral 21 in FIG. 1 and further illustrated in FIGS. 3, 4, and 17 is installed. For purposes of illustration, different styles of window surround molding are shown in FIGS. 1, 3, 4, and 17. The window surround molding may or may not include sills as shown in FIGS. 1, 2, and 3, and may have single piece side molding sections as shown in FIG. 1, or two or more pieces forming the side sections as illustrated in FIG. 3. As illustrated in FIGS. 1 and 17, a limestone sill 80 has top and bottom edge slots engagable by single anchors 60 at the top edge of the sill and double anchors 32 along the bottom edge of the sill to attach the sill to the wallboard 24 across the bottom of a window. If necessary, for spacing considerations, a limestone spacer panel 81 may be installed below the window sill between the sill and the next limestone panel 10 below the window. The spacer panel 81 is mounted on the wallboard 24 using double anchors 32 as shown in FIG. 17. FIG. 3 illustrates a different design of limestone window sill 82 which is installed using single and double anchors as illustrated in FIG. 17. The sides of a window may be single section limestone moldings 83 as shown in FIG. 1, or may be made of multiple sections 84 and 85 as illustrated in FIG. 3. The side section window surround molds having square ends, such as the molds 85, have end edge anchor slots which are engaged with wide double anchors 32 holding the side molds to the wallboard 24. As shown in FIG. 3, the bottom double anchors 32 engage both the bottom sill 82 and the lower ends of the window side molds 85 to the wallboard. The side mold sections 83 shown in FIGS. 1 and the upper side mold sections 84 illustrated in FIG. 3 have mitered corner joints with the top or header mold sections 90, see FIGS. 1, 3, and 17. The upper end angled edges of the side molds 83 and 84 have edge anchor slots for engagement by double anchors 32 to attach the angled ends to the wallboard 24, FIG. 3. Similarly, the mitered end edges of the headers 90 also include the anchors lots for attachment to the wallboard 24. In the window shown in FIG. 3, the bottom edges of the limestone mold header 90 have anchor edge slots engaged by single anchors 60 attaching the bottom edge of the window mold header 90 to the wallboard 24. More specific details are shown in FIG. 4 of the attachment of an upper end of one of the window side molds by an anchor 32 to the wallboard 24. In the window construction of FIG. 4, a bottom window molding section 91 is shown with mitered corners attached to the wallboard 24 by a double anchor 32. FIG. 4 also shows a bottom side window molding section 92 which has a square upper end edge and a mitered lower end edge illustrating the installation of a window which uses a bottom or sill section 91 matching the sides and top header sections of the window molding.

While the details of various designs of window surround molding have been described and illustrated, it is to be understood that identical door surround molding and installation techniques may be used where a door opens through a wall using the limestone veneer of the invention. More specifically, the side molding 83 and the top molding 90 shown in FIG. 1 and the side molding 84 and 85 and the top molding 90 shown in FIG. 3 may be used along the sides and top of a door. Because the bottom of doors are at floor level, limestone components are not normally installed across the bottom.

Figure 14:
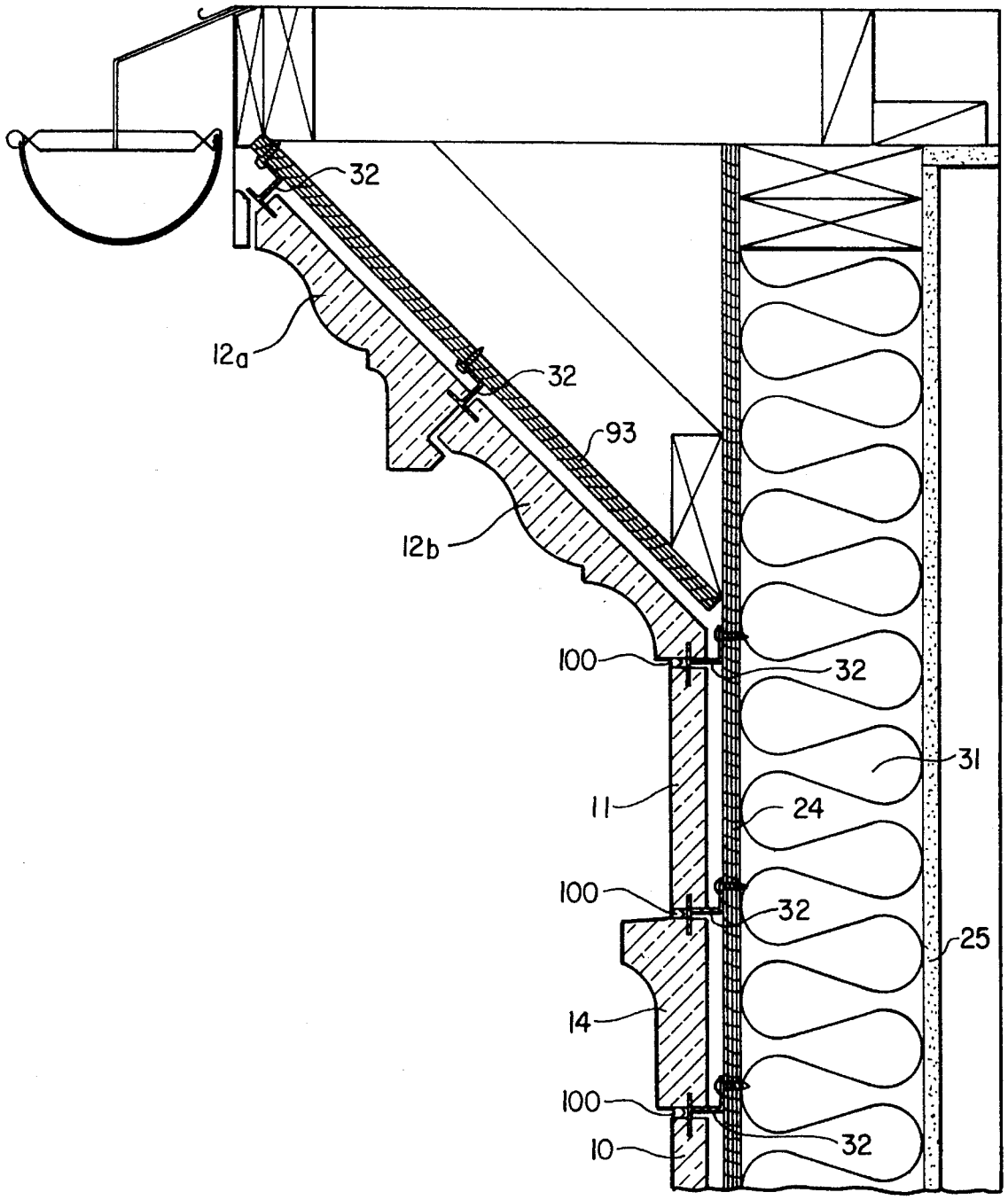
FIG. 14 is a fragmentary side view in section of limestone entablature molding along the wall of a building in accordance with the invention.

The limestone veneer installation illustrated in FIGS. 1 and 14, includes an entablature formed by the cornice 12, the frieze 13, and the architrave 14. As apparent in these illustrations, the entablature comprises the limestone veneer along a building below the roof line above a wallboard 24 veneered with the limestone wall panels 10. As illustrated in FIG. 14, the cornice is formed in two sections **12*a* and 12*b* each of which has upper and lower edge anchor slots engaged by double anchors 32 to attach the cornice members to the wallboard 24 and to a cornice board 93. The frieze 11, mounted below the cornice also includes upper and lower edge anchor slots which receive anchors 32 for attachment to the wallboard 24 as shown in FIG. 14. Similarly, the architrave 14 has upper and lower edge anchor slots engaged by anchors 32 attaching the architrave to the wallboard below the frieze 11 and above the upper or top row of the limestone wall panels 10**.

Figure 11:
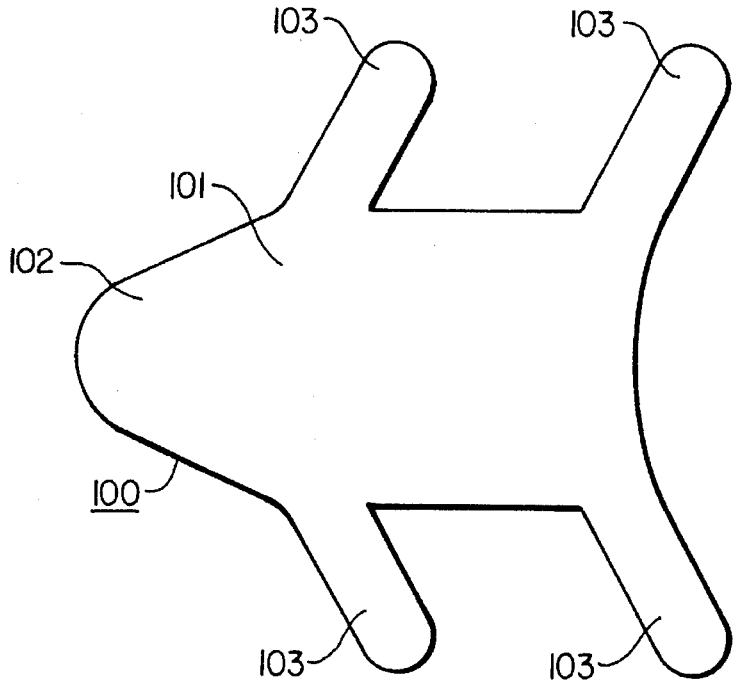
FIG. 11 is an enlarged view in cross section of an extruded plastic joint sealer for use between the edges of adjacent limestone wall panels and moldings in the invention.

The joints between the various limestone components may be left open, may be sealed using known caulking materials, or, preferably, using an extrued silicone joint sealer 100 as illustrated in FIG. 11. The joint sealer 100 has a central body portion 101 having a nose end 102 and integral side fins 103. The joint sealer 100 is installed in the joints between the limestone components as illustrated in FIG. 13 by inserting the strip with the nose 102 entering the joint first and the fins 103 folding and compressing inwardly to tightly secure the sealer strip in the joint between the limestone edges. The reactive forces in the sealer strip due to the compression of the side fins 103 holds the joint sealer strip tightly in the joints in which it is installed.

Figure 18:
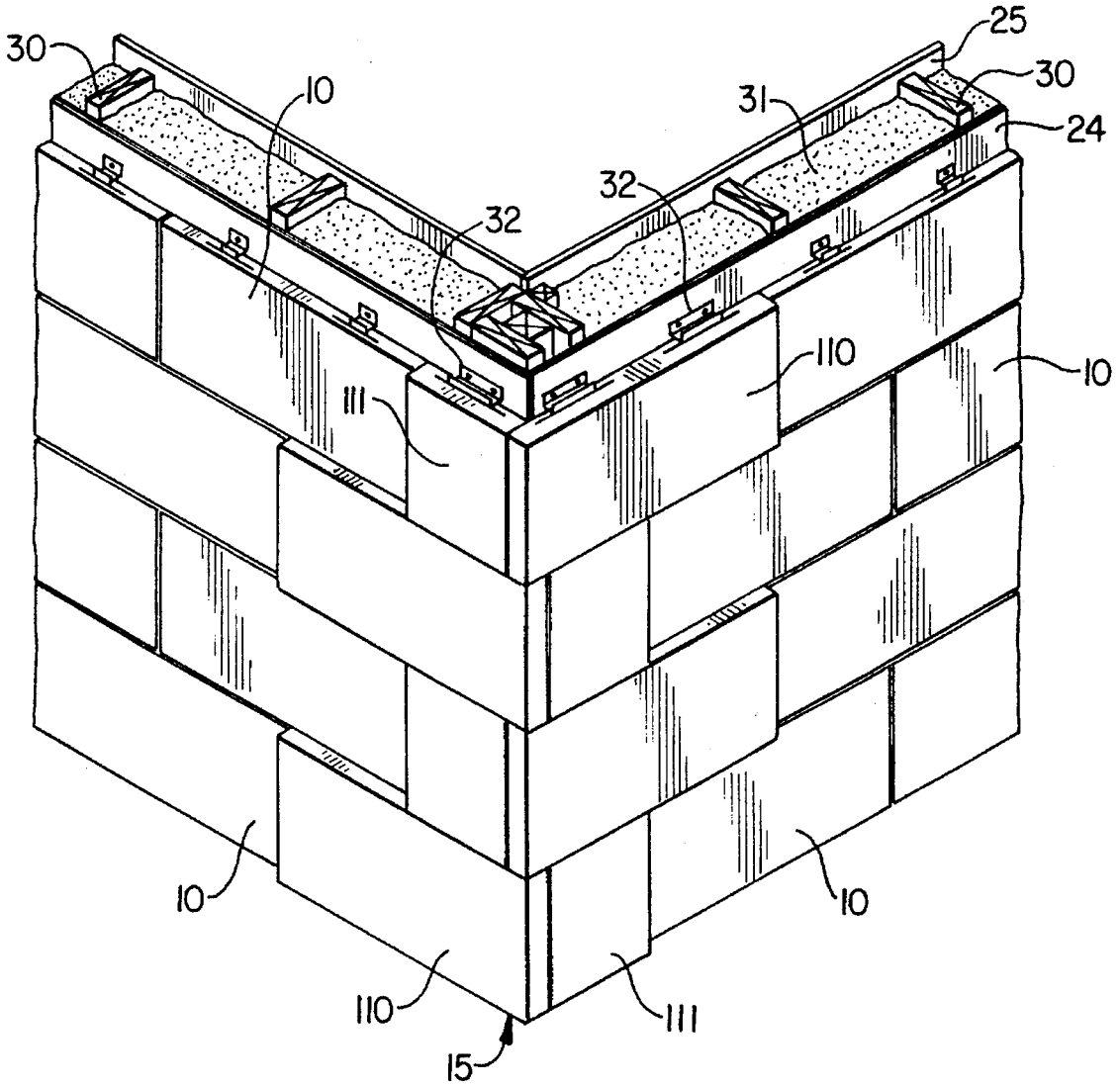
FIG. 18 is a fragmentary perspective view section and elevation of the construction details of a portion of a quoined corner illustrated in FIG. 1.

Referring to FIG. 18, the quoined corner 15 of the limestone veneer installation includes overlapping limestone wall panels 110 and 111. Both the panels 110 and 111 are approximately twice the thickness of the wall panels 10 which make up the major portions of the walls of a structure. The panels 111 are much smaller than the panels 110 to provide the aesthetic appearance illustrated in FIGS. 1 and 18. The panels 110 include upper and lower edge anchor slots for connection of the panels to the wallboard 24 using the anchors 32. Because of the smaller size of the panels 111, they include only a single top and lower edge anchor slot which also is engaged by the anchors 32 for attachment of the panels 111 to the wallboard 24. If the quoined corner detail is not desired, a conventional corner of the limestone veneer installation of the invention includes corner panels of the same relative sizes as the panels 110 and 111 but of the same thickness as the other wall panels 10.

It will now be seen that while exemplary embodiments of a limestone veneer system for walls, in accordance with the invention, have been described and illustrated, it will be apparent that numerous other design features may be employed within the scope the following claims.

What is claimed is:

1. A limestone veneer curtain wall system for the interior and exterior walls of buildings having walls including wallboard sheathing, a water table section along a lower portion of the sheathing, and a foundation beam below the sheathing comprising:

(a) horizontal, vertically spaced, rows of anchors attachable to a front face of the sheathing, each anchor having a back portion provided with an opening for attaching means to hold the anchor to the sheathing, an intermediate portion extending outwardly from the back portion, and a front portion extending from the intermediate portion and shaped and sized to engage an edge slot in a limestone wall panel;

(b) horizontal, vertically spaced, rows of limestone wall panels engageable by the anchors supporting the wall panels in coplanar relationship substantially parallel with the sheathing, each of the wall panels having upper and lower edge slots spaced and sized for engagement by the front portions of the anchors for supporting the wall panels along the sheathing;

(c) horizontal, vertically spaced, rows of the anchors attachable across the lower portion of the front face of the sheathing and across the foundation beam below the sheathing; and (d) one or more limestone members selected from the group consisting of molding and base panel members engagable by the anchors along the lower portion of the sheathing and the foundation beam in coplanar relationships supportable from the lower portion of the sheathing and the foundation beam along the water table section; and (e) a water resistant membrane along the foundation beam below and behind the limestone base and moldings across the water table section; and (f) a baffel member below the limestone base on the foundation beam foot.

2. A limestone veneer system for walls of buildings having foundation beams and drywalls provided with wallboard sheathing comprising:

(a) single anchor means securable along the foundation beam, the anchor means having a back portion securable to the beam, an intermediate portion extending perpendicular to the back portion, and a front portion extending perpendicular and upwardly from the outward end of the intermediate portion for engagement in an edge slot of a limestone water table base panel;

(b) a horizontal row of limestone water table base panels having upper and lower edge slots supported on the bottom anchor means, the front portion of the anchor means engaging the bottom edge slots of the limestone water table base panels;

(c) a second horizontal row of double anchors attachable along a lower portion of the wallboard sheathing above the foundation beam, each of the double anchors having a back portion attachable to the wallboard, an intermediate portion extending outwardly perpendicular to the back portion, and a front portion, extending upwardly and downwardly perpendicular to the intermediate portion sized and shaped to engage upper edge slots in the limestone water table base panels and lower slots in a limestone water table molding member;

(d) a row of limestone water table molding members supported on the second row of double anchors, the upper front portion of the double anchors each engaging a bottom edge slot in the limestone water table moldings;

(e) a third and suceeding rows of horizontal vertically spaced double anchors securable along the wallboard sheathing above the second row of double anchors;

(f) a plurality of rows of horizontal vertically spaced limestone wall panels each having upper and lower edge slots engageable by the front portions of the third and successive rows of double anchors along the sheathing supporting the limestone wall panels in coplanar relationship spaced from the wallboard sheathing;

(g) a plurality of horizontal vertically spaced rows of double anchors securable across the wallboard sheathing and across a cornice wallboard sheathing above the plurality of limestone wall panels for securing a limestone entablature to the dry wall of the building;

(h) a limestone architrave having upper and lower edge slots supported on the double anchors above the top limestone wall panels;

(i) a row of limestone frieze panels each having upper and lower edge slots engageable by the double anchors above the architrave panels;

(j) one or more horizontal rows of limestone cornice molding having edge slots engageable by the double anchors above the limestone frieze panels for supporting the limestone cornice moldings on the building dry wall;

(k) it water repellent member for covering the foundation beam behind and below the limestone water table base panel; and (l) a baffel member for mounting on the beam behind the limestone water table base panel attached to the beam.

* * * * *